US006210530B1

(12) United States Patent
Loser et al.

(10) Patent No.: US 6,210,530 B1
(45) Date of Patent: Apr. 3, 2001

(54) PRESS SECTION AND METHOD FOR PRESSING WITH DIFFERENT SHOE PRESS LENGTHS

(75) Inventors: Hans Loser, Langenau; Joachim Henssler, Ravensburg; Karl Steiner, Herbrechtingen; Josef Müellner, Heidenheim, all of (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 08/989,916

(22) Filed: Dec. 12, 1997

(30) Foreign Application Priority Data

Dec. 13, 1996 (DE) ..... 196 52 018

(51) Int. Cl.[7] ..... D21F 3/04

(52) U.S. Cl. ..... 162/205; 162/360.2; 162/360.3; 162/358.3

(58) Field of Search ..... 162/358.3, 358.5, 162/360.2, 360.3, 205

(56) References Cited

U.S. PATENT DOCUMENTS

| | | | | |
|---|---|---|---|---|
| 4,931,143 | * | 6/1990 | Karvinen et al. | 162/360.2 |
| 5,178,732 | * | 1/1993 | Steiner et al. | 162/360.3 |
| 5,256,257 | | 10/1993 | Schiel | 162/360.3 |
| 5,662,778 | * | 9/1997 | Laapotti | 162/360.2 |
| 5,681,431 | * | 10/1997 | Steiner | 162/360.2 |
| 5,705,034 | * | 1/1998 | Schiel | 162/358.3 |

FOREIGN PATENT DOCUMENTS

| | | |
|---|---|---|
| 4301750 | 7/1994 | (DE) . |
| 29613944 | 12/1996 | (DE) . |
| 0496965 | 8/1992 | (EP) . |
| 0608533 | 8/1994 | (EP) . |

* cited by examiner

*Primary Examiner*—Karen M. Hastings
(74) *Attorney, Agent, or Firm*—Greenblum & Bernstein, P.L.C.

(57) ABSTRACT

Press section of a machine for producing a fibrous web and process for pressing a fibrous web. The press section may include at least two shoe press units including at least one press shoe and a revolving flexible press belt, a counterpart face, at least two nips having a length extended in a web travel direction and formed by each at least one press shoe pressing the revolving flexible press belt against the counterpart face. A length of the extended nip may be at least substantially the same as a length of the at least press shoe length, measured in the web travel direction, forming the extended nip and at least one of the shoe press units having press shoe length different from the other shoe press units, whereby various extended nip length are formed. The process may include positioning a first of the at least two nips upstream, with respect to the web travel direction, a last of the at least two nips, wherein one of the first and last nips has a nip length greater than the other and applying different pressing forces in the at least two nips such that the one of the first and last nip having a greater length has a lesser pressing force applied.

29 Claims, 2 Drawing Sheets

PRESS SECTION AND METHOD FOR PRESSING WITH DIFFERENT SHOE PRESS LENGTHS

CROSS-REFERENCE TO RELATED APPLICATION

The present application claims priority under 35 U.S.C. § 119 of German Patent Application No. 196 52 018.5 filed Dec. 13, 1996, the disclosure of which is expressly incorporated by reference herein in its entirety.

BACKGROUND OF THE INVENTION

1. Field of the Invention

The present invention relates to a press section of a machine for producing a fibrous web, e.g., a paper or cardboard web, having at least two nips extended in length in a web travel direction. Each of the at least two nips is formed between a revolving flexible press belt of a shoe press unit and a counterpart face. The flexible press belt can be pressed against the counterpart face by at least one press shoe associated with the respective shoe press unit. The respective nip length may be determined at least substantially by the press shoe length, measured in the web travel direction, of the associated shoe press unit.

2. Discussion of Background Information

The advantages of extended nip presses known in the art include, inter alia, that the nip is no longer substantially linear but instead is two-dimensional. In this manner, the still-wet fibrous web is exposed to pressing pressure over a longer distance and, thus, is more intensively dewatered. Further, the onset of pressure in the nip is no longer sudden. Instead, the pressure can be brought continuously, e.g., from a low value to a high value, thus, avoiding a risk that the fibrous web will become crumpled in the nip.

In previous conventional press sections similar in general to the type described above, the shoe press units associated with the various nips have identical press shoes, or press shoes of equal length. Thus, the press section includes nips of the same length.

SUMMARY OF THE INVENTION

The present invention provides a press section of the type generally described above, while retaining as simple and compact a structure of the shoe press units as possible to ensure optimal handling of the fibrous web.

In accordance with the present invention, nips of various lengths may be formed. In forming the various lengths of nips, at least some of the shoe press units have different press shoe lengths.

In another embodiment of the present invention, the shoe press unit associated with the first nip in the web travel direction has a greater press shoe length than the shoe press unit associated with the last nip in the web travel direction.

The shoe press unit associated with the first nip in the web travel direction may advantageously have a press shoe length approximately two to five times as long as the shoe press unit associated with the last nip in the web travel direction.

In an alternative embodiment of the present invention, the shoe press unit associated with the first nip in the web travel direction may have a press shoe length less than the shoe press unit associated with the last nip in the web travel direction.

In a particularly advantageous embodiment of the present invention, three shoe press units may be provided. The shoe press unit associated with the first nip in the web travel direction may have a greater press shoe length than a middle shoe press unit, and the press shoe length of the middle shoe press unit may be greater than a press shoe length of a shoe press unit associated with the last nip in the web travel direction.

It may be particularly advantageous, in accordance with the present invention, to provide a ratio of press shoe lengths of the shoe press unit associated with the first nip in the web travel direction, the middle shoe press unit, and the shoe press unit associated with the last nip in the web travel direction to be, e.g., approximately 3:2:1. Alternatively, the ratio may be, e.g., approximately 3.5:1.5:1.

Preferably, the linear forces generated in the various nips are at least substantially equal in magnitude. Alternatively, at least some of the linear forces generated in the various nips may be different from one another. In the latter case, the linear force generated in the first nip in the web travel direction may be advantageously less than the linear force generated in the last nip in the web travel direction, and the linear forces, in the web travel direction, preferably increase from one nip to the next in the web travel direction.

A relatively slight linear force in the first nip in the web travel direction has a decisive advantage in that more compact shoe press units, and, in the case of a shoe press roll, press rolls having lesser diameters may be utilized. In the case of a shoe press roll, the diameter may be, e.g., less than approximately one meter.

It is also especially advantageous if at least some of the resultant pressure profiles in the various nips are different from one another. This may involve either the pressure profiles that result crosswise (transverse) to the web travel direction, or to the pressure profiles that result in the web travel direction.

The lubrication of at least some of the various shoe press units, e.g., with oil, water or the like, may differ from the others.

The present invention can also be utilized when a given counterpart face is formed by a counter roll, and a plurality of shoe press units, e.g., two, are associated with that counter roll.

Accordingly, the present invention is directed to a press section of a machine for producing a fibrous web. The press section may include at least two shoe press units including at least one press shoe and a revolving flexible press belt, a counterpart face, at least two nips having a length extended in a web travel direction and formed by each at least one press shoe pressing the revolving flexible press belt against the counterpart face. A length of the extended nip may be at least substantially the same as a length of the at least press shoe length, measured in the web travel direction, forming the extended nip and at least one of the shoe press units having press shoe length different from the other shoe press units, whereby various extended nip length are formed.

In accordance with another feature of the present invention, the press shoe of the shoe press unit associated with a first nip in the web travel direction may have a length greater than the press shoe of the shoe press unit associated with a last nip in the web travel direction. Further, the press shoe of the shoe press unit associated with the first nip may have a length approximately two to five times greater than the press shoe of the shoe press unit associated with the last nip.

In accordance with another feature of the present invention, the press shoe of the shoe press unit associated with a first nip in the web travel direction may have a length less than the press shoe of the shoe press unit associated with a last nip in the web travel direction.

In accordance with still another feature of the present invention, the at least two extended nips may include at least three extended nips and at least three shoe press units. Further, the three shoe press units may include a first shoe press unit associated with a first nip in the web travel direction, a second press unit associated with a middle nip in the web travel direction, and a last press unit associated with a last nip in the web travel direction. The at least one press shoe of the first shoe press may have a length greater than the at least one press shoe of the middle shoe press and the at least one press shoe of the middle shoe press unit may have a length greater than the at least one press shoe of the last shoe press.

In accordance with a further feature of the present invention, the ratio of the lengths of the at least one press shoe of the first shoe press unit, the at least one press shoe of the middle shoe press unit, and the at least one press show of the last shoe press unit may be 3:2:1. Alternatively, the ratio of the lengths of the at least one press shoe of the first shoe press unit, the at least one press shoe of the middle shoe press unit, and the at least one press show of the last shoe press unit may be 3.5:1.5:1.

In accordance with another feature of the present invention, the pressing of the revolving flexible press belt may generate linear forces in the nips and the linear forces may be at least substantially of equal magnitude.

In accordance with still another feature of the present invention, the pressing of the revolving flexible press belt may generate linear forces in the nips and at least some of the linear forces may be different from one another. Further, the linear force generated in a first nip in the web travel direction may be less than the linear force generated in a last nip in the web travel direction. Still further, the linear forces may increase in subsequent nips arranged in the web travel direction.

In accordance with a further feature of the present invention, each nip may exhibit a resultant pressure profile and at least some of the resultant pressure profiles may be different from one another.

In accordance with still another feature of the present invention, the device may also include lubrication for the shoe press units. The lubrication of at least some of the various shoe press units may differ from that of the others.

In accordance with another feature of the present invention, the at least two shoe presses may include a double-felted first shoe press, a subsequently arranged roll press, and a subsequently arranged second shoe press. Further, a length of the extended nip of the second shoe press may be shorter than a length of the extended nip of the first shoe press.

In accordance with another feature of the present invention, the fibrous web may include at least one of a paper and cardboard web.

The present invention may be directed to a process for pressing a fibrous web in a press section of a web producing machine. The press section having at least two shoe press units, each comprising at least one press shoe and a revolving flexible press belt, a counterpart face, at least two nips having a length extended in a web travel direction and formed by each at least one press shoe pressing the revolving flexible press belt against the counterpart face, a length of the extended nip being at least substantially the same as a length of the at least press shoe length, measured in the web travel direction, forming the extended nip, and at least one of the shoe press units having press shoe length different from the other shoe press units, whereby various extended nip length are formed. The process may include positioning a first of the at least two nips upstream, with respect to the web travel direction, a last of the at least two nips, wherein one of the first and last nips has a nip length greater than the other, and applying different pressing forces in the at least two nips such that the one of the first and last nip having a greater length has a lesser pressing force applied.

According to another feature of the present invention, the process may also include selecting the press shoe for forming the first nip to have a length greater than a length of the press shoe for forming the last nip. Further, the process may include selecting the length of the press shoe forming the first nip to have a length between approximately two to five times greater than the length of the press shoe forming the last nip.

In accordance with another feature of the present invention, the process may further include selecting the press shoe for forming the first nip to have a length less than a length of the press shoe for forming the last nip.

In accordance with a further feature of the present invention, the process includes forming the at least two nips against a single counter roll.

In accordance with a still further feature of the present invention, the process includes positioning a middle nip between the first and last nips in the web travel direction, selecting a press shoe length forming the middle nip to have a length between the lengths of the press shoes forming the first and last nips, and applying a pressing force to the middle nip having a magnitude between the pressing forces applied in the first and last nips.

In accordance with another feature of the present invention, the process may further include selecting the press shoe for forming the first nip to have a length greater than a length of the press shoe for forming the last nip. Further, the process may include selecting the length of the press shoe forming the first nip to have a length approximately three times greater than the length of the press shoe forming the last nip, and selecting the length of the press shoe forming the middle nip to have a length approximately two times greater than the length of the press shoe forming the last nip. Alternatively, the process may include selecting the length of the press shoe forming the first nip to have a length approximately 3.5 times greater than the length of the press shoe forming the last nip, and selecting the length of the press shoe forming the middle nip to have a length approximately 1.5 times greater than the length of the press shoe forming the last nip.

In accordance with another feature of the present invention, the length of the first press shoe is between approximately 100 mm and 1000 mm, the length of the middle press shoe is between approximately 40 mm and 400 mm, and the length of the last press shoe is between approximately 30 and 300 mm. Preferably, the length of the first press shoe is between approximately 200 mm and 600 mm, the length of the middle press shoe is between approximately 120 mm and 300 mm, and the length of the last press shoe is between approximately 60 and 200 mm. Most preferably, the length of the first press shoe is approximately 500 mm, the length of the middle press shoe is approximately 200 mm, and the length of the last press shoe is approximately 120 mm.

According to yet another feature of the present invention, the applying of different pressing force includes applying a linear press force in the first nip of between approximately 5 kN/m and 1000 kn/m, applying a linear press force in the middle nip of between approximately 100 kN/m and 2000 kN/m, and applying a linear press force in the last nip of between approximately 600 kN/m and 3000 kN/m. More preferably, the applying of different pressing force includes applying a linear press force in the first nip of between approximately 20 kN/m and 200 kN/m, applying a linear press force in the middle nip of between approximately 200 kN/m and 800 kN/m, and applying a linear press force in the last nip of between approximately 800 kN/m and 1500 kN/m. Most preferably, the applying of different pressing force includes applying a linear press force in the first nip of approximately 100 kN/m, applying a linear press force in the middle nip of approximately 400 kN/m, and applying a linear press force in the last nip of approximately 1000 kN/m.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein.

DETAILED DESCRIPTION OF THE PRESENT INVENTION

Figure 1:
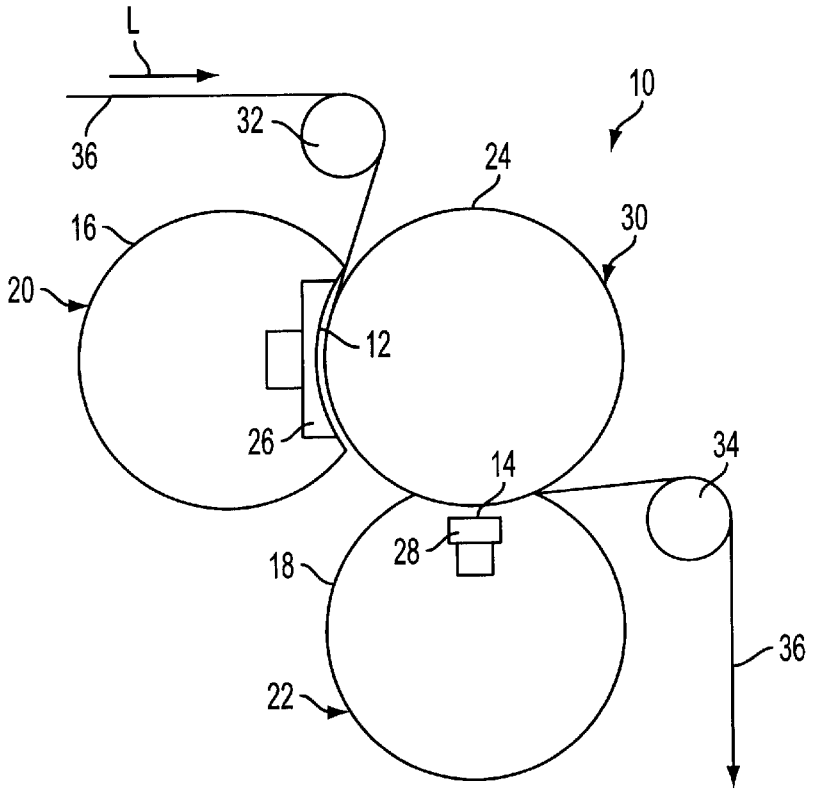
FIG. 1 illustrates a schematic side view of one embodiment of a press section.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

FIG. 1, in a purely schematic fragmentary view, illustrates a press section 10 of a machine for producing a fibrous web, e.g., a web of at least one of paper and cardboard.

A press section 10 includes two nips 12 and 14 having an extended length in a web travel direction L. Each of nips (extended nips) 12 and 14 are formed between respective revolving flexible press belt 16 and 18 of respective shoe press units 20 and 22 and a counterpart face 24. Flexible press belts 16 and 18 may be pressed against counterpart face 24 via at least one respective press shoe 26 and 28 associated with respective shoe press units 20 and 22.

In the exemplary case, counterpart face 24 may be formed by a common, so-called central counter roll 30, and shoe press units 20 and 22 may be associated with central counter roll 30.

A respective nip length for extended nips 12 and 14 may be determined at least substantially by a length of press shoe 26 and 28, measured in web travel direction L, associated with shoe press units 20 and 22, respectively.

Extended nips 12 and 14 may be felted on one side, e.g., using a common belt screen or felt band 36 guided via a plurality of deflection rolls, of which only deflection rolls 32 and 34 are shown.

In the exemplary embodiment shown, shoe press units 20 and 22 may each be formed by one shoe press roll having a revolving flexible pressing jacket 16 and 18 to act as a press belt.

As shown in FIG. 1, shoe press units 20 and 22 may have different press shoe lengths. Accordingly, extended nips 12 and 14 will have correspondingly different extended nip lengths.

Figure 3:
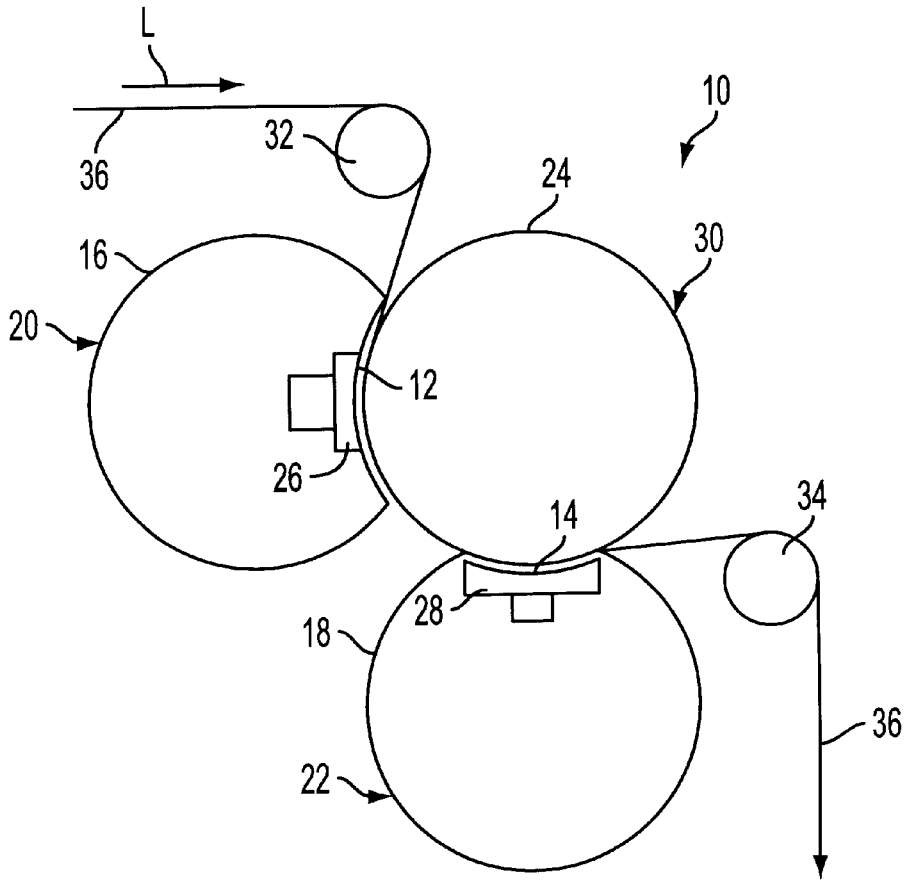
FIG. 3 illustrates an alternative arrangement of the press section depicted in FIG. 1.

In the illustrated embodiment, press shoe 26 of shoe press unit 20, which is associated with the front extended nip 12 in web travel direction L, may have a greater length than press shoe 28 of shoe press unit 14, which is associated with the rear nip 22 in web travel direction L. The press shoe length of shoe press unit 20 may be, e.g., approximately two to five times as long as the press shoe length of shoe press unit 22. In an alternative arrangement, as shown in FIG. 3, press shoe 26 of shoe press unit 20, which is associated with the front extended nip 12 in web travel direction L, may have a length less than a length of press shoe 28 of shoe press unit 22, which is associated with the rear nip 22 in web travel direction L.

Figure 2:
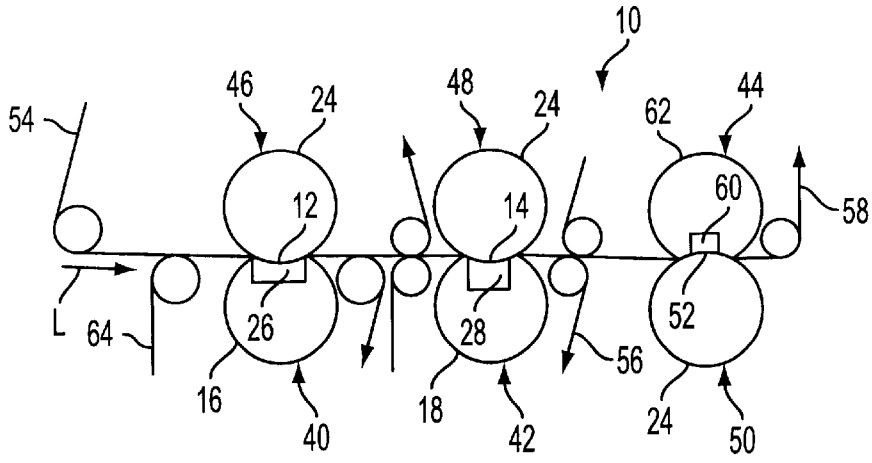
FIG. 2 illustrates a schematic side view of a further embodiment of a press section.

In the exemplary embodiment illustrated in FIG. 2, three shoe press units 40, 42, and 44 are shown. Each shoe press unit is associated with a counter roll 46, 48, and 50, respectively, that forms the respective counterpart face 24. Shoe press units 40, 42, and 44 may be formed with shoe press rolls having flexible roll jacket 16, 18, and 62 acting as press belts.

The three extended nips 12, 14, and 52 formed by the associated shoe press units and counter rolls may each be either felted on one side or double-felted. As shown in the illustrated embodiment, upper belt screens (or felt bands) 54 and 58 may be associated with extended nips 12 and 52. Lower belt screens (or felt bands) 56 and 64 may be associated with extended nips 14 and 12, respectively.

While in terms of the web travel direction L, the first and second shoe press units 40 and 42 are each positioned below their associated counter rolls 46 and 48, the third shoe press unit 44 is positioned above its associated counter roll 50.

Shoe press units 40, 42, and 44 may include press shoes 26, 28, and 60, and each press shoe may be of a different length. In the exemplary embodiment, the length of press shoe 26 of shoe press unit 40 associated with the first extended nip 12 in web travel direction L may be greater than the length of press shoe 28 of middle shoe press unit 42; and the length of press shoe 28 of middle shoe press unit 42 may be greater than the length of press shoe 60 of the shoe press unit 44 associated with the last nip 52 in web travel direction L.

For example, the length of the press shoe for the first nip in the web travel direction is, e.g., between approximately 100 mm and 1000 mm, preferably between approximately 200 mm and 600 mm, and most preferably approximately 500 mm. The length of the press shoe for the middle nip in the web travel direction is, e.g., between approximately 40 mm and 400 mm, preferably between approximately 120 mm and 300 mm, and most preferably approximately 200 mm. The length of the press shoe for the last nip in the web travel direction is, e.g., between approximately 30 mm and 300 mm, preferably between approximately 60 mm and 200 mm, and most preferably approximately 120 mm.

The linear forces generated in the various nips may be of equal magnitude or different magnitudes. In other words, the linear forces may be the same, each linear force may be different, or some of the linear forces may be the same and others different. In accordance with the present invention, the linear force generated in the first nip in web travel direction L may be less than the linear force generated in the last nip in web travel direction L. The linear forces, in web travel direction L, preferably increase from one extended nip to the next. Further, at least some of the resultant pressure profiles in the various nips may be different from one another. Finally, it is also within the perview of the present invention to provide different lubrication for at least some of the various shoe press units.

For example, the linear forces generated in the first nip in the web travel direction is, e.g., between approximately 5 kN/m and 1000 kN/m, preferably between approximately 20 kN/m and 200 kN/m, and most preferably approximately 100 kN/m. The linear forces generated in the middle nip in the web travel direction is, e.g., between approximately 100 kN/m and 2000 kN/m, preferably between approximately 200 kN/m and 800 kN/m, and most preferably approximately 400 kN/m. The linear forces generated in the last nip in the web travel direction is, e.g., between approximately 600 kN/m and 3000 kN/m, preferably between approximately 800 kN/m and 1500 kN/m, and most preferably approximately 1000 kN/m.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

LIST OF REFERENCE NUMERALS

10 Press section
12 Nip
14 Nip
16 Press belt
18 Press belt
20 Shoe press unit
22 Shoe press unit
24 Counterpart face
26 Press shoe
28 Press shoe
30 Counter roll
32 Deflection roll
34 Deflection roll
36 Belt screen or felt band
38 Nip
40 Shoe press unit
42 Shoe press unit
44 Shoe press unit
46 Counter roll
48 Counter roll
50 Counter roll
52 Nip
54 Belt screen or felt band
56 Belt screen or felt band
58 Belt screen or felt band
60 Press shoe
62 Press belt
64 Belt screen or felt band
L Web travel direction

What is claimed:

1. A press section of a machine for producing a fibrous web comprising:

at least two shoe press units, each comprising at least one press shoe and a revolving flexible press belt;

a counterpart face;

at least two nips having a length extended in a web travel direction and formed by each at least one press shoe pressing the revolving flexible press belt against the counterpart face;

a length of the extended nip being at least substantially the same as a length of the at least press shoe length, measured in the web travel direction, forming the extended nip;

at least one of the shoe press units having a press shoe length different from the other shoe press units, whereby various extended nip lengths are formed;

the pressing of the revolving flexible press belt generating linear forces in the nips;

at least some of the linear forces being different from one another;

the at least two extended nips comprising at least three extended nips formed by at least three shoe press units;

the three shoe press units comprising a first shoe press unit associated with a first nip in the web travel direction, a second press unit associated with a middle nip in the web travel direction, and a last press unit associated with a last nip in the web travel direction;

the at least one press shoe of the first shoe press having a length greater than the at least one press shoe of the middle shoe press; and the at least one press shoe of the middle shoe press unit having a length greater than the at least one press shoe of the last shoe press;

the ratio of the lengths of the at least one press shoe of the first shoe press unit, the at least one press shoe of the middle shoe press unit, and the at least one press shoe of the last shoe press unit being 3:2:1, wherein the three extended nips comprise three successive shoe press nips located directly adjacent to each other, a second press nip being located immediately downstream of a first press nip, a third press nip being located immediately downstream from the second press nip, each shoe press nip being formed by its own respective pair of press rolls and at least one press felt passing through each extended nip.

2. The press section of claim 1, wherein the three extended nips comprise three successive shoe press nips located directly adjacent to each other, a second press nip being located immediately downstream of a first press nip, a third press nip being located immediately downstream from the second press nip, each shoe press nip being formed by its own respective pair of press rolls and at least one press felt passing through each extended nip.

3. A process for pressing a fibrous web in a press section of a web producing machine, the press section having at least two shoe press units, each comprising at least one press shoe and a revolving flexible press belt, a counterpart face, at least two nips having a length extended in a web travel direction and formed by each at least one press shoe pressing the revolving flexible press belt against the counterpart face, a length of the extended nip being at least substantially the same as a length of the at least press shoe length, measured in the web travel direction, forming the extended nip, and at least one of the shoe press units having a press shoe length different from the other shoe press units, whereby various extended nip lengths are formed, the process comprising:

positioning a first of the at least two nips upstream, with respect to the web travel direction, a last of the at least two nips, wherein one of the first and last nips has a nip length greater than the other;

applying different linear pressing forces in the at least two nips such that the one of the first and last nip having a greater length applies a lesser pressing force;

positioning a middle nip between the first and last nips in the web travel direction;

selecting a press shoe length forming the middle nip to have a length between the lengths of the press shoes forming the first and last nips; and applying a linear pressing force to the middle nip having a magnitude between the linear pressing forces applied in the first and last nips;

wherein the length of the first press shoe is approximately 500 mm, wherein the length of the middle press shoe is approximately 200 mm, wherein the length of the last press shoe is approximately 120 mm, and wherein the three extended nips comprise three successive shoe press nips located directly adjacent to each other, a second press nip being located immediately downstream of a first press nip, a third press nip being located immediately downstream from the second press nip, each shoe press nip being formed by its own respective pair of press rolls and at least one press felt passing through each extended nip.

4. A press section of a machine for producing a fibrous web, comprising:

a deflection roll followed by at least a first nip and a second nip;

the first nip being formed by a first shoe press unit and a common counter roll, wherein the first nip generates a first linear force between approximately 5 kN/m and 1000 kN/m;

the second nip formed by a second shoe press unit and the common counter roll, wherein the second nip generates a second linear force between approximately 100 kN/m and 2000 kN/m;

a belt running in a web running direction for carrying the web, the belt traveling first over the deflection roll, then through the first nip, and thereafter through the second nip;

each of the first and second shoe press units comprising one of a flexible press belt and a flexible press jacket;

the first shoe press unit further comprising a press shoe having a first length extended in the web running direction; and the second shoe press unit further comprising a press shoe having a second length extended in the web running direction;

wherein the first length is approximately 2 to 5 times as long as the second length, and wherein the linear force generated in the second nip is greater than the linear force generated in the first nip by a factor of greater than approximately 2 times.

5. The press section of claim 4, further comprising another deflection roll positioned downstream of the second nip.

6. The press section of claim 4, wherein at least one of the press shoes of the first and second shoe press units is concavely curved.

7. The press section of claim 6, wherein each of the press shoes of the first and second shoe press units is concavely curved.

8. The press section of claim 4, wherein the first nip is adapted to have a first pressure profile and wherein the second nip is adapted to have a second pressure profile which is different from the first pressure profile, wherein one of the first pressure profile and the second pressure profile results crosswise to the web travel direction.

9. The press section of claim 4, wherein one of the first and second shoe press units are lubricated.

10. The press section of claim 9, wherein one of the first and second shoe press units are lubricated with one of oil and water.

11. The press section of claim 9, wherein the first shoe press unit is lubricated differently than the second shoe press unit.

12. The press section of claim 4, wherein one of the first and second shoe press units comprise a shoe press roll having a diameter less than approximately one meter.

13. A press section of a machine for producing a fibrous web, comprising:

a deflection roll followed by at least a first nip, a second nip, and a third nip;

the first nip being formed by a first shoe press unit and a first counter roll, wherein the first nip generates a first linear force between approximately 5 kN/m and 1000 kN/m;

the second nip formed by a second shoe press unit and a second counter roll, wherein the second nip generates a second linear force between approximately 100 kN/m and 2000 kN/m;

the third nip formed by a third shoe press unit and a third counter roll, wherein the third nip generates a third linear force between approximately 600 kN/m and 3000 kN/m;

a belt running in a web running direction for carrying the web, the belt traveling first over the deflection roll, then through at least the first nip;

the second nip being disposed in the web running direction after the first nip and the third nip being disposed in the web running direction after the second nip;

each of the first, second, and third shoe press units comprising one of a flexible press belt and a flexible press jacket;

the first shoe press unit further comprising a press shoe having a first length extended in the web running direction;

the second shoe press unit further comprising a press shoe having a second length extended in the web running direction;

the third shoe press unit further comprising a press shoe having a third length extended in the web running direction;

wherein the first length is at least approximately 2 times as long as the second length, wherein the first length is at least approximately 3 times as long as the third length, wherein the linear force generated in the second nip is greater than the linear force generated in the first nip by a factor of greater than approximately 2 times, and wherein the linear force generated in the third nip is greater than the linear force generated in the first nip by a factor of greater than approximately 3 times.

14. The press section of claim 13, further comprising another deflection roll positioned downstream of the third nip.

15. The press section of claim 13, wherein at least one of the press shoes of the first, second, and third shoe press units is concavely curved.

16. The press section of claim 15, wherein each of the press shoes of the first, second, and third shoe press units is concavely curved.

17. The press section of claim 13, wherein the first nip is adapted to have a first pressure profile, the second nip is adapted to have a second pressure profile which is different from the first pressure profile, and wherein the third nip is adapted to have a third pressure profile which is different from the first and second pressure profiles, wherein one of the first, second, and third pressure profiles results crosswise to the web travel direction.

18. The press section of claim 13, wherein one of the first, second, and third shoe press units are lubricated.

19. The press section of claim 18, wherein one of the first, second, and third shoe press units are lubricated with one of oil and water.

20. The press section of claim 18, wherein the first shoe press unit is lubricated differently than the second shoe press unit and wherein the third shoe press unit is lubricated differently than the first and second shoe press units.

21. The press section of claim 13, wherein one of the first, second and third shoe press units comprise a shoe press roll having a diameter less than approximately one meter.

22. The press section of claim 13, wherein the first shoe press unit comprises a double-felted shoe press.

23. The press section of claim 13, wherein the first length is between approximately 100 mm and 1000 mm, wherein the second length is between approximately 40 mm and 400 mm, and wherein the third length is between approximately 30 mm and 300 mm.

24. The press section of claim 23, wherein the first length is between approximately 200 mm and 600 mm, wherein the second length is between approximately 120 mm and 300 mm, and wherein the third length is between approximately 60 mm and 200 mm.

25. The press section of claim 24, wherein the first length is approximately 500 mm, wherein the second length is approximately 200 mm, and wherein the third length is approximately 120 mm.

26. The press section of claim 13, wherein the first linear force is between approximately 20 kN/m and 200 kN/m, wherein the second linear force is between approximately 200 kN/m and 800 kN/m, and wherein the third linear force is between approximately 800 kN/m and 1500 kN/m.

27. The press section of claim 26, wherein the first linear force is approximately 100 kN/m, wherein the second linear force is approximately 400 kN/m, and wherein the third linear force is approximately 1000 kN/m.

28. A process for pressing a fibrous web in a press section of a machine for producing the fibrous web, the process comprising:

providing a deflection roll followed by at least a first nip and a second nip;

forming the first nip with a first shoe press unit and a common counter roll, wherein the first nip generates a first linear force between approximately 5 kN/m and 1000 kN/m;

forming the second nip with a second shoe press unit and the common counter roll, wherein the second nip generates a second linear force between approximately 100 kN/m and 2000 kN/m;

moving a belt in a web running direction for carrying the web, the belt traveling first over the deflection roll, then through the first nip, and thereafter through the second nip;

providing each of the first and second shoe press units with one of a flexible press belt and a flexible press jacket;

providing the first shoe press unit with a press shoe having a first length extended in the web running direction; and providing the second shoe press unit with a press shoe having a second length extended in the web running direction;

wherein the first length is approximately 2 to 5 times as long as the second length, and wherein the linear force generated in the second nip is greater than the linear force generated in the first nip by a factor of greater than approximately 2 times.

29. A process for pressing a fibrous web in a press section of a machine for producing the fibrous web, the process comprising:

providing a deflection roll followed by at least a first nip, a second nip, and a third nip;

forming the first nip with a first shoe press unit and a first counter roll, wherein the first nip generates a first linear force between approximately 5 kN/m and 1000 kN/m;

forming the second nip with a second shoe press unit and a second counter roll, wherein the second nip generates a second linear force between approximately 100 kN/m and 2000 kN/m;

forming the third nip with a third shoe press unit and a third counter roll, wherein the third nip generates a third linear force between approximately 600 kN/m and 3000 kN/m;

moving a belt in a web running direction for carrying the web, the belt traveling first over the deflection roll, then through at least the first nip;

disposing the second nip in the web running direction after the first nip;

disposing the third nip in the web running direction after the second nip;

providing each of the first, second, and third shoe press units with one of a flexible press belt and a flexible press jacket;

providing the first shoe press unit with a press shoe having a first length extended in the web running direction;

providing the second shoe press unit with a press shoe having a second length extended in the web running direction;

providing the third shoe press unit with a press shoe having a third length extended in the web running direction;

wherein the first length is at least approximately 2 times as long as the second length, wherein the first length is at least approximately 3 times as long as the third length, wherein the linear force generated in the second nip is greater than the linear force generated in the first nip by a factor of greater than approximately 2 times, and wherein the linear force generated in the third nip is greater than the linear force generated in the first nip by a factor of greater than approximately 3 times.

* * * * *